US006276306B1

(12) United States Patent
Murphy et al.

(10) Patent No.: US 6,276,306 B1
(45) Date of Patent: Aug. 21, 2001

(54) APPARATUS FOR RECOVERING HYDROCARBONS FROM GRANULAR SOLIDS

(76) Inventors: Michael L. Murphy, 2880 Packsaddle Dr., Coeur d'Alene, IL (US) 83815; James M Scranton, N. 24660 Scranton Rd., Athol, ID (US) 83801; Ronald A Siverson, S. 2410 Greens Ferry, Coeur D'Alene, ID (US) 83814; Michael K. Kologi, P.O. Box 372, Osburn, ID (US) 83849

( * ) Notice: Subject to any disclaimer, the term of this patent is extended or adjusted under 35 U.S.C. 154(b) by 0 days.

(21) Appl. No.: 09/632,107

(22) Filed: Aug. 3, 2000

(51) Int. Cl.[7] ..... F27B 15/00

(52) U.S. Cl. ..... 122/7 R; 110/245; 432/14; 432/58; 432/72

(58) Field of Search ..... 432/58, 14, 72; 110/245, 345; 122/4 D, 7 R

(56) References Cited

U.S. PATENT DOCUMENTS

| | | | | |
|---|---|---|---|---|
| 3,977,947 | * | 8/1976 | Pyle | 432/58 |
| 4,181,494 | * | 1/1980 | Kimberley | 432/14 |
| 5,140,950 | * | 8/1992 | Abdulally | 122/4 D |
| 5,481,063 | * | 1/1996 | Hiltunen et al. | 110/342 |
| 5,715,764 | * | 2/1998 | Lyngfelt et al. | 110/245 |
| 5,915,311 | * | 6/1999 | Muller et al. | 110/345 |
| 5,919,038 | * | 7/1999 | Labelle et al. | 432/58 |

* cited by examiner

*Primary Examiner*—Gregory Wilson
(74) *Attorney, Agent, or Firm*—David S. Thompson

(57) ABSTRACT

An apparatus (10) for recovering hydrocarbons or other volatile material from granular solids includes an infeed conveyor (20) that moves the mud, containing a mixture of particulate solids and hydrocarbons, into the fluid bed (40). The fluid bed fluidizes the mud; i.e. transforms the mud from a first condition wherein it is a mass having a consistency with elements of similarity with oatmeal, to a second condition wherein it is a mass of swirling particles. Some of the particles leave the fluid bed through a slide gate at the bottom. Other particles, gas and the hydrocarbons leave the fluid bed through an opening at the top, and are transferred to one or more cyclones (60). In the cyclones, the rapid circular motion of the gas, hydrocarbons and particles results in the particles hitting the inside surface of the cyclone, sliding downwardly, and leaving the cyclone through a slide gate. The mixture of gas and hydrocarbons leave the cyclone and moves through a spray apparatus (80), which removes the hydrocarbons from the mixture, and into an oil-condensing tank (100). A fan assembly (120) draws gas from an upper portion of the oil-condensing tank and delivers it to a preheater (140) where the temperature of the gas is elevated. The heated gas is then recirculated by release through a plurality of nozzles within the fluid bed. A thermal fluid heat source (220) provides heat energy to in-bed tubes within the fluid bed and to the gas preheater.

13 Claims, 8 Drawing Sheets

APPARATUS FOR RECOVERING HYDROCARBONS FROM GRANULAR SOLIDS

CROSS-REFERENCES

There are no applications related to this application filed in this or any foreign country.

BACKGROUND OF THE INVENTION

1. Field of the Invention

The present invention relates to an apparatus for removing volatile material from solids. More particularly, the invention relates to an apparatus for removing hydrocarbons from earth, dirt, rock cuttings, drilling mud and similar materials. Still more particularly, the invention relates to an apparatus including a heating means, a fluidized bed, cyclones and fluid circulation means for separation of hydrocarbons and removal of solid material.

2. Related Information.

It is a vital environmental concern that the volatile material be removed from granular solids; i.e. the hydrocarbons must be removed from earth, dirt, and similar materials. The removal of hydrocarbons that have soaked into the ground over a period of time is now known as "remediation" and the number of recognized sites has grown astronomically. Former refinery and chemical manufacturing and storage facilities are typical sites of such work. Even the location where a gasoline service station once stood is a candidate for "remediation." Other locations where remediation may be desirable or required are dry cleaners, junk or storage yards, automobile-related businesses and garbage dumps.

An area of particular application of the instant invention, in which volatile materials must be removed from granular solids, is the reclamation of petroleum lubricated drilling fluids used in the exploration and production of petroleum oils. The drilling fluid, referred to as "mud," serves several purposes, the most important of which includes cooling and lubricating the bit and removing drilled solids, or cuttings, from the bore hole. While it is essentially a water based, fluid composition, the drilling mud is frequently compounded with a lubricant material such as diesel, crude oil or other non-water petroleum based constituent to facilitate the mud's lubricating characteristics.

The mud is usually contained in a mud pit, which is connected by way of a mud line and mud pump to a hose and swivel used to inject the mud into the top of the drill pipe. The returning mud, combined with the cuttings, is captured in a mud return pipe and recirculated through the drill pipe.

When the concentration of the drill cuttings in the mud rises too high, recirculation of the mud becomes a problem. In order for the mud to perform its several functions, its viscosity, density and other properties must be maintained within acceptable limits. The drill cuttings adversely affect these properties thus reducing the carrying capacity and lubricating ability of the mud, possibly damaging the drilling equipment.

To allow for effective recirculation, the mud is usually separated from the cuttings prior to being recycled through the drill pipe. The cuttings are then disposed of as waste. This presents problem when the lubricating properties of the mud have been enhanced by the addition of hydrocarbons. Because of the hydrocarbons mixed in with the cuttings, a hazardous waste problem is present. Upon completion of the use of the mud in the well, the mud itself becomes waste that must be remediated for the same reasons.

Historically, the contaminated cuttings and mud were diluted by mixing, and hauled to remote sites for disposal in landfills. This, however, also presents a problem in that the landfill then becomes a hazardous waste site, possibly leaving the dumper liable for environmental damages indefinitely.

Decontaminating the materials is the more environmentally attractive option. Treatment processes heretofore available to remove oil or other hydrocarbons from cuttings and mud include distillation, solvent washing, and mud burning. While these processes are effective to varying degrees at stripping the hydrocarbon contaminants from cuttings and mud particulates and rendering them environmentally clean, the processes remain problematic in that of disposal of the liquid or vapor from the disassociated contaminant.

There are several patents that disclose technology related to rotary kilns specifically designed to remove volatile hydrocarbons from solid material such as soil. See, for example, U.S. Pat. Nos. 5,152,233; 5,199,354; 5,302,118, and 5,378,059. All of the rotary kilns are gas fired with the hot combustion gases being directed into the drum to heat the solids. Unfortunately, when the solids have a substantial quantity of hydrocarbonaceous material an explosion hazard may be present. In an addition environmental hazard, when a flame is applied directly to the solids, the contaminants are oxidized and turned into smoke and other forms of air pollution. This process prevents recycling of the hydrocarbons for reuse in the same or similar drilling operation.

What is needed is a method by which the hydrocarbons used in the drilling operation may be separated from the mud taken from a drilling site. Once separated, the hydrocarbons could be safely recycled into the same drilling site, thereby preventing environmental damage and also reducing the cost of hydrocarbons required during the drilling process. When the drilling was completed, the hydrocarbons could be relocated to a new drilling site for reuse and further recycling.

SUMMARY

The present invention is directed to an apparatus that satisfies the above needs. A novel apparatus for recovering hydrocarbons from solids is disclosed that allows the hydrocarbons to be reused for the same or similar operation, to be otherwise recycled, or to be disposed of in an environmentally safe manner.

The apparatus for recovering hydrocarbons from solids of the present invention provides some or all of the following structures.

(A) An infeed conveyor 20 moves the mud, containing a mixture of particulate solids and hydrocarbons, into the fluid bed. A preferred infeed conveyor includes an intake tube containing a co-axially oriented drive screw. As the drive screw revolves, mud is fed driven up the intake tube, down a chute and into the fluid bed. A mass of mud between an upper portion of the drive screw and the chute prevents material from leaving the fluid bed by means of the intake tube.

(B) A fluid bed 40 fluidizes the mud; i.e. the fluid bed transforms the mud from a first condition wherein it is a mass having a consistency with elements of similarity with oatmeal, to a second condition wherein it is a mass of swirling particles.

Within an enclosure defining the fluid bed, a plenum provides gas at elevated temperature and pressure to a plurality of manifolds. Each manifold supports a plurality of nozzles that release the heated gas. The hot gas released from the nozzles at elevated pressure breaks up the mud from an initial cohesive condition to a resulting condition resembling a sandstorm. Thermal fluid moving through in-bed heating tubes provides additional heat to the fluidized portion of the fluid bed.

Particles above the level of the nozzles tend to behave as a swirling mass, while particles below the nozzles tend to accumulate in one or more inverted cones at the base of the fluid bed. Light-weight hydrocarbon molecules remain in the swirling, fluidized portion of the fluid bed. A slide gate, located at the narrow opening at the lowest level of each cone, allows removal of particulate matter, from which the hydrocarbons have been separated.

(C) One or more cyclones removes particulate matter from the mixture of hot gas, particulate matter and volatilized hydrocarbons.

A mixture of hot gas, some particulate matter and volatilized hydrocarbons is allowed to leave an upper portion of the fluid bed. In a preferred embodiment, a portion of the mixture is sent to each of a pair of cyclones 60 or other separating device. Use of two or more cyclones results in sufficient output, and allows use of cyclones of a suitable height for portable transit purposes and minimized diameter for optimal particulate separation.

The mixture enters each cyclone through a tangential air inlet tube, resulting in rapid circular, or angular, motion. The angular velocity of any particle within the mixture increases as the particle moves downwardly within an outside region of the cyclone, due to the tapering design of the cyclone. The angular velocity of any cleaned particle within the mixture further increases as the particle begins to move upwardly in a spiral through a middle portion of the cyclone.

Due to the tangential velocity of the spiraling motion of each particle in the mixture, heavier particles, tend to impact the inside surface of the cyclone and drop down to a slide gate at the base of each cyclone. As the particles accumulate, they are removed through the slide gate and an associated exhaust tube.

(D) A condensing apparatus such as the spray apparatus 80 removes hydrocarbons from a mixture of hot gas and hydrocarbons.

The mixture of hot gas and hydrocarbons is removed from the top of each cyclone and transferred through the spray apparatus 80. The spray apparatus removes the hydrocarbons from suspension within the mixture by spraying an oil mist into the mixture of hot gas and hydrocarbons. The oil mist tends to remove the bulk of the hydrocarbons from the hot gas.

(E) A demister 90 (mist removal apparatus) or disengaging cyclone may be used with or instead of the condensing apparatus. The demister receives the mixture of hot gas and condensed hydrocarbons from the spay apparatus and removes an additional quantity of hydrocarbons from the hot gas.

(F) An oil-condensing tank 100 receives the mixture of gas and liquid oil from the demister or disengaging cyclone. The oil originally carried by the gas has condensed due to passage through the spray apparatus, demister and/or disengaging cyclone. Having been removed from the gas, the condensed oil accumulates in the oil-condensing tank.

(G) A fan assembly 120 draws the gas out of the oil-condensing tank and delivers it under pressure to the gas preheater.

(H) A gas preheater 140 heats the gas prior to its transfer to the plenum of the fluid bed.

(I) A thermal fluid heat source provides heated oil or other fluid which is circulated into the gas preheater 140 and the in-bed heating tubes within the fluid bed.

It is therefore a primary advantage of the present invention to provide a novel apparatus for recovering hydrocarbons from granular solids that uses a fluid bed to fluidize the "mud", at least one cyclone to separate the particulate matter from the hot gas and hydrocarbons, and a spray apparatus to condense the hydrocarbons from suspension within the hot gas stream.

Another advantage of the present invention is to provide a novel apparatus for recovering hydrocarbons from granular solids that results in a greater recovery rate than prior art recovery devices using rotating drums and augers, and which leaves the "mud" in a state that is not considered to be hazardous waste. The remediated dirt, soil, cuttings are therefore not considered to be a hazardous waste, and may therefore be disposed of inexpensively.

A still further advantage of the present invention is to provide a novel apparatus for recovering hydrocarbons from granular solids that is well-adapted to high-volume applications, wherein a large quantity of "mud" is processed, resulting in the recycling of hydrocarbons and the elimination of hazardous waste.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

DESCRIPTION

Figure 1:
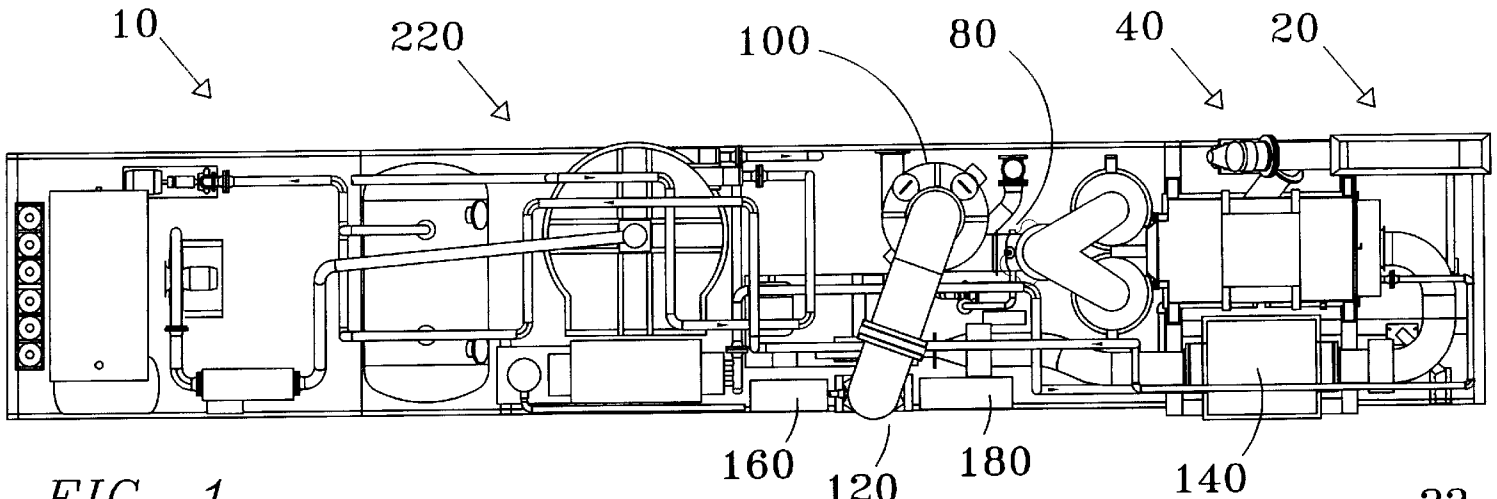
FIG. 1 is a orthographic plan view of a version of the apparatus for recovering hydrocarbons from granular solids of the invention.

In a typical drilling application related to the exploration and production of petroleum oils, diesel-like drilling fluid is injected into a well being drilled at a rate of approximately 300 gallons per minute. The drilling fluid serves several purposes, the most important of which includes cooling and lubricating the bit. The drilling fluid, when mixed with earth, dirt and other materials during the drilling process, is then referred to as "mud," due to appearance, or "cuttings," due to the number of small rock particles that have been cut from the well by the bit.

The mud removed from the well, is no longer useful as drilling fluid, due to the small rock fragments and other contaminants. Similarly, the mud cannot be disposed of without addressing environmental issues, due to the contamination of the drilling fluid, which prevents routine dumping.

In a typical application, some drilling fluid is separated from the mud by passing the mud through a shaker screen and then through a centrifuge. However, a significant quantity of hydrocarbon-based drilling fluid remains mixed with the mud, and as a result, the mud remains an environmental hazard. It is therefore important to remove additional drilling fluid from the mud, so that the drilling fluid may be recycled and the mud may be disposed of without damaging the environment.

Referring in general to FIGS. 1 through 5, an apparatus 10 for recovering hydrocarbons or other volatile material from granular solids constructed in accordance with the principles of the invention is seen. An infeed conveyor 20 moves the mud, containing a mixture of particulate solids and hydrocarbons, into the fluid bed 40. The fluid bed fluidizes the mud; i.e. transforms the mud from a first condition wherein it is a mass having a consistency with elements of similarity with oatmeal, to a second condition wherein it is a mass of swirling particles. Some of the particles leave the fluid bed through a slide gate at the bottom.

Other particles, gas and the hydrocarbons leave the fluid bed through an opening at the top, and are transferred to one or more cyclones 60. In the cyclones, the rapid angular motion of the gas, hydrocarbons and particles results in the particles, which have a high tangential velocity, hitting the inside surface of the cyclone, sliding downwardly, and leaving the cyclone through a slide gate. The mixture of gas and hydrocarbons leaves the cyclone and move through a spray apparatus 80, which cools the gas and hydrocarbons to a suitable temperature for condensation of hydrocarbons for the gas and then removes the hydrocarbons from suspension within the mixture. The remaining hydrocarbons are removed from the hot gas by a demister or disengaging cyclone. The gas and fluid hydrocarbons are then transferred into an oil-condensing and deintrainment tank 100. The tank 100 may include a demisting (mist removal) assembly. A fan assembly 120 draws gas from an upper portion of the oil-condensing tank and delivers it under pressure to a preheater 140 where the temperature of the gas is elevated. The heated gas is released through a plurality of nozzles within the fluid bed. A thermal fluid heat source 220 provides heat energy to in-bed tubes within the fluid bed and to the gas preheater.

Figure 2:
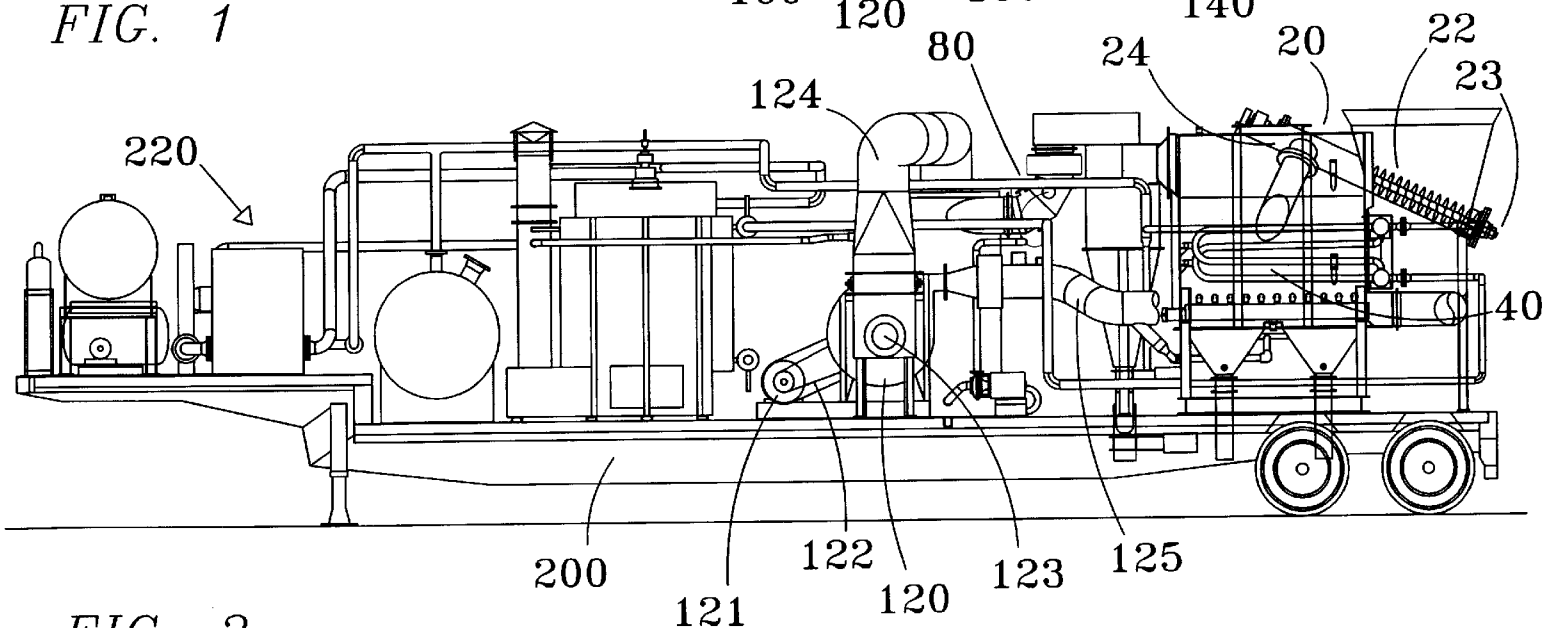
FIG. 2 is a side orthographic view of the hydrocarbon recovery apparatus of FIG. 1.
Figure 3:
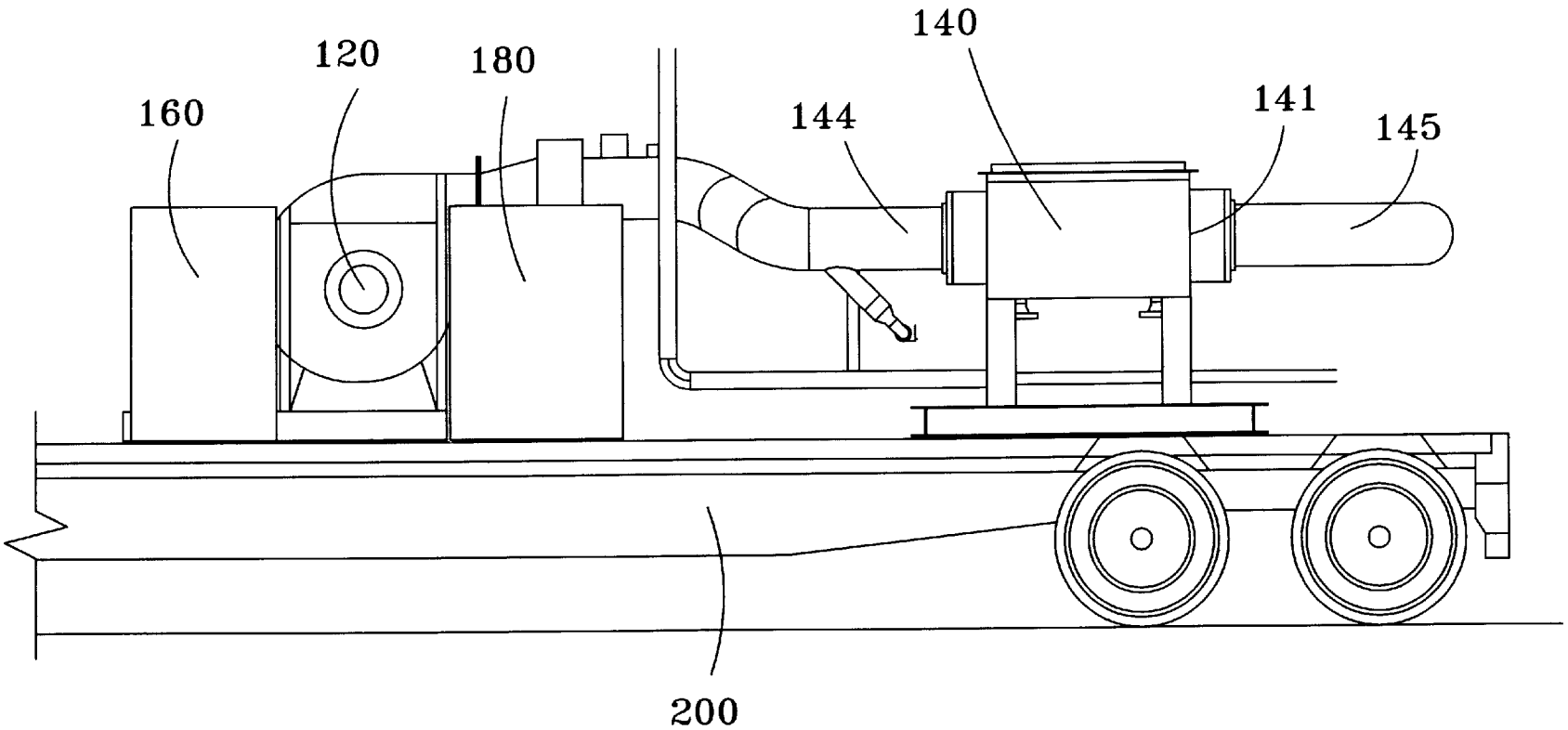
FIG. 3 is a partial side orthographic view of the hydrocarbon recovery apparatus of FIG. 1.

As seen in FIGS. 1 and 2, an infeed mechanism 20 moves the mud, containing a mixture of particulate solids and hydrocarbons, into the fluid bed 40. A preferred infeed mechanism is a conveyor that includes an intake tube 21 containing a co-axially oriented drive screw 22. As the drive screw revolves, mud enters the infeed conveyor through an input end 28 of the intake tube 21, travels within the intake tube, and exits through a tubular chute 30 into the fluid bed 40.

In the infeed conveyor of the preferred version of the invention, seen in FIGS. 1 and 2, the intake tube 21 is oriented in a manner that moves the mixture of particulate solids and hydrocarbons both upwardly and horizontally. An upper portion of the intake tube is connected in a fluid-tight manner to an upper portion of the tubular chute 30. As seen in FIG. 2, the chute is oriented at approximately 90 degrees to the intake tube. An output end 31, defined in a lower portion of the chute, allows passage of the mixture into the enclosed fluid bed 40.

Continuing to refer to both FIGS. 1 and 2, the drive screw 22 is carried by a screw shaft 23. The screw shaft is supported by a bearing 27 and turned by a drive belt 25. The drive belt in turn is driven by a drive motor 26.

At an upper portion of the intake tube, the mud is diverted down a tubular chute 30 in communication with the intake tube 21. The mud that exits the chute moves into the fluid bed.

A mass of mud carried in a plug area 29, seen in FIG. 2 in an upper portion 24 of the tube, between the upper end of the drive screw and the upper end of the chute 30, prevents gas under pressure from leaving the fluid bed by means of the infeed conveyor 20.

Figure 8:
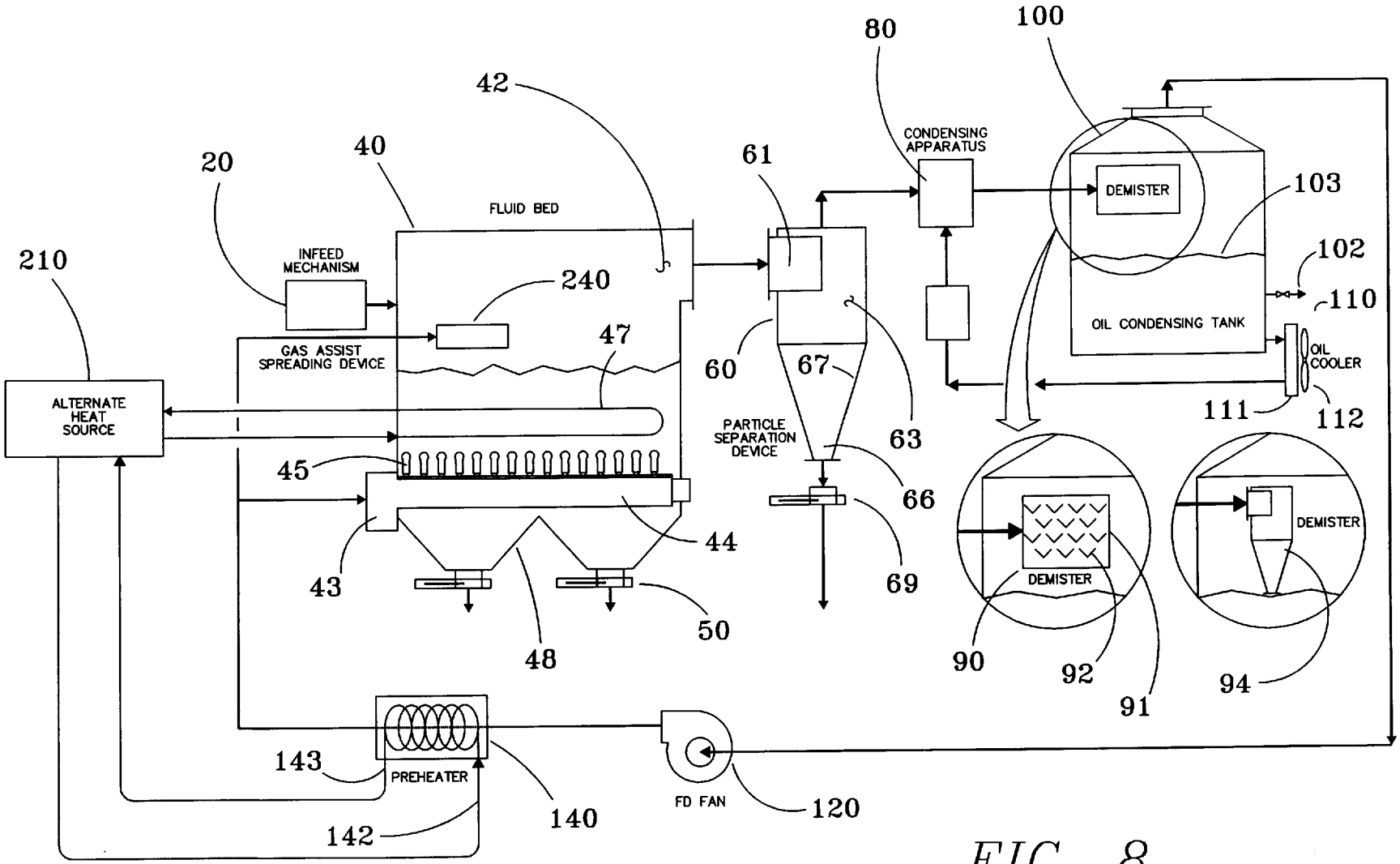
FIG. 8 is a diagrammatic view of an apparatus similar to that seen in FIG. 1, having a demister device located in the oil-condensing tank, a gas assist spreading device located within the fluid bed and an external radiator type oil cooler attached to the oil-condensing tank.
Figure 9:
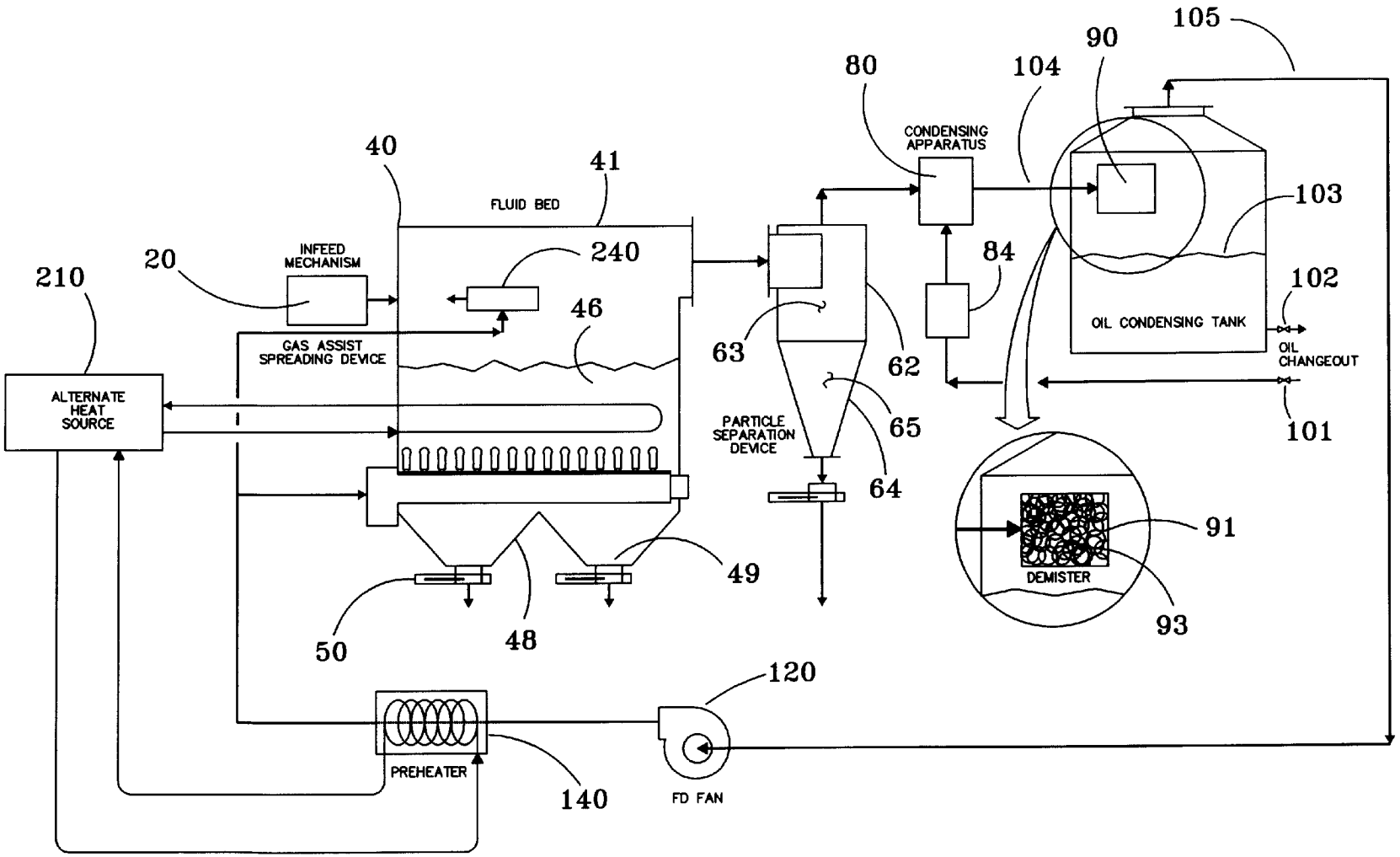
FIG. 9 is a diagrammatic view of an apparatus similar to that seen in FIG. 8, having facilities for cooling the oil-condensing tank by changing out the supply.

Referring to FIGS. 8 and 9 where the infeed mechanism 20 is generically illustrated, the infeed mechanism may alternatively include a variety of known devices, such as a concrete pump, non-screw type conveyor, slurry pump or similar apparatus suitable for moving a quantity of particulate matter mixed with hydrocarbon elements.

Referring to FIGS. 8 and 9, two versions of a gas assist spreading device 240 can be seen. The gas assist spreading devices are located within the fluid bed, and use high-pressure gas to break up accumulations of the mixture of particulate solids and hydrocarbons as it is loaded into the fluid bed.

In both versions, gas under pressure from the force draft fan assembly 120, having been heated by the gas preheat 140, is released by the gas assist spreading device. The direction and velocity of the gas released into the fluid bed tends to prevent the mixture of particulate solids and hydrocarbons loaded into the fluid bed by the infeed mechanism 20 from accumulating in one location.

The gas assist spreading devices of FIGS. 8 and 9 use stationary or moving high pressure gas jets to break the mixture of particulate solids and hydrocarbons loaded into the fluid bed into small pieces, and to move the small pieces in a manner that tends to distribute them evenly throughout the fluid bed.

A fluid bed 40 fluidizes the mud, i.e. fluidizes the mixture of particles and hydrocarbons. More particularly, the fluid bed transforms the mixture from a first condition wherein the mixture is a mass of material having a consistency with elements of similarity with oatmeal, to a second condition wherein the mixture is a mass of swirling particles. A first purpose of fluidizing the mixture is to allow some of the larger particulate material, such as rock fragments, to be exhausted through the slide gate 50 at the base of the fluid bed. A second purpose of fluidizing the mixture is to convert the remainder of the particulate material, heated gas and the hydrocarbons, into a state of movement similar to a sandstorm and that is suitable for transfer to one or more cyclones 60 to further separate the particles from the hydrocarbons.

The fluid bed is defined within a gas-tight enclosure 41. Gas under pressure from the fan assembly 120 and heated by the preheater 140, is introduced into the plenum 43. In a preferred embodiment of the invention, the plenum provides heated gas at elevated pressure to a plurality of manifolds 44. Each manifold supports a plurality of nozzles 45 arrayed in an evenly distributed manner, as seen in FIGS. 1 and 2. The nozzles collectively release the heated gas delivered to the plenum and distributed by the manifolds within the enclosure 41.

Use of a plenum and a plurality of manifolds tend to result in more uniform pressure delivery to each nozzle. However, in an alternative embodiment, the heated, pressurized gas may be delivered directly to a manifold that supports one or more nozzles. Or, as a still further alternative, each nozzle may be individually supplied by a layout of pipes.

The hot gas released from the nozzles at elevated pressure and temperature breaks up the mud from an initial cohesive condition to a resulting condition resembling a sandstorm; i.e., the material comprising the mixture is "fluidized." As seen in FIG. 2, the fluidized portion 46 of the fluid bed is that portion above the nozzles 45, which is in turbulence.

Thermal fluid moving through in-bed heating tubes 47 provides additional heat to the fluidized portion of the fluid bed. The additional heat tends to volatilize the hydrocarbons.

The fluid bed is considered to be "fluidized" at a level approximately equal to the level of the nozzles. In operation, particles above the level of the nozzles tend to behave as a swirling mass, while particles below the nozzles tend to accumulate in one or more inverted cones 48 at the base of the fluid bed. Lightweight hydrocarbon molecules remain in the swirling, fluidized portion of the fluid bed.

The portion of the fluid bed below the nozzles comprises relatively static granular particulates, including "cuttings" from the rock through which the well was drilled. These granular particulates have been separated from any hydrocarbons, which, within the fluid bed enclosure, remain suspended in the swirling heated gas.

At least one slide gate 50, located at the lowest level or bottom tip 49 of each of at least one inverted pyramid (i.e. point oriented down; rectangular base oriented upwardly), regulates the removal of the particles, from which the hydrocarbons have been separated. Upper and lower pressure sensors provide information that allows the operation of the slide gate to be regulated. The upper pressure sensor 54 is located in an upper location 42 of the enclosure. The lower pressure sensor 55 is located immediately below the level of the nozzles. In operation, when the pressure in the lower sensor becomes sufficiently greater than the pressure in the upper sensor, the slide gates are used to exhaust particulate matter from the fluid bed. In this manner, the quantity of material within the fluid bed may be regulated.

In the closed state, the slide gate 50 prevents the passage of particulate material. In an open state, the particulate material leaving the fluid bed enclosure moves between the input 51 and output 52 of the slide gate, and is then released by an exhaust tube 53 onto the ground or a conveyor.

As seen in FIG. 2, an inert gas, such as Nitrogen, may be used to cool and flood the fluid bed and connected devices should the oxygen content and temperature become too great.

As seen in FIGS. 8 and 9, the mixture of hot gas, some particulate matter and hydrocarbons is allowed to leave an upper portion 42 of the fluid bed 40. In a preferred embodiment, half of the mixture is sent to each of a pair of cyclones 60. Use of two cyclones results in sufficient output, and allows use of cyclones of a suitable height. Within the cyclones, the particulate matter is separated from the mixture, and is exhausted from the base of each cyclone. The remaining mixture of hot gas and hydrocarbons is then transferred to the spray apparatus 80.

Each cyclone 60 is formed from a hollow cylindrical upper body 62 and a hollow conical lower body 64. The upper body defines a cylindrical upper cavity 63 that is in communication with the conical lower cavity 65. A tangential inlet tube 61 allows the mixture of hot gas, some particulate matter and hydrocarbons to transfer from an upper location 42 within the enclosure 41 of the fluid bed 40 into the cylindrical upper cavity 63.

Due to a pressure differential, the mixture moves rapidly from the fluid bed through the tangential air inlet tube 61 into each cyclone. Due to the tangential path of the gas flow, the mixture travels in a downwardly directed spiral, through the hollow cylindrical upper cavity 63. The downwardly directed spiral is adjacent to the inside surface 67.

As the mixture spirals downwardly into the conical lower cavity 65, the spiral path followed by the particles contained in the mixture becomes tighter, due to the tapered sidewalls of the conical lower body 64. At the base of the lower conical body, the mixture begins a very tight upwardly directed spiral about the axis of the cyclone. As a result, the spiral path followed by the particles in the downward direction within the cyclone is radially outwardly of the spiral path followed by the particles in the upward direction.

During the downward spiral, and to an even greater degree during the upward spiral, the mixture of particulate matter, hydrocarbons and gas moves at a very high angular speed with a large tangential component. Due to the tangential velocity, particulate matter tends to impact the inside surface 67 of the cyclone. The impact causes the particulate matter to lose velocity. Having lost velocity, the particles drop down into, and accumulate within, a lower portion 66 of the lower cavity 65.

A slide gate 69 is at the base of each cyclone, below the accumulation of particulate matter. After a sufficient quantity of particulate matter accumulates, the slide gate is opened, and the particulate matter is removed through an exhaust tube 70.

Figure 5:
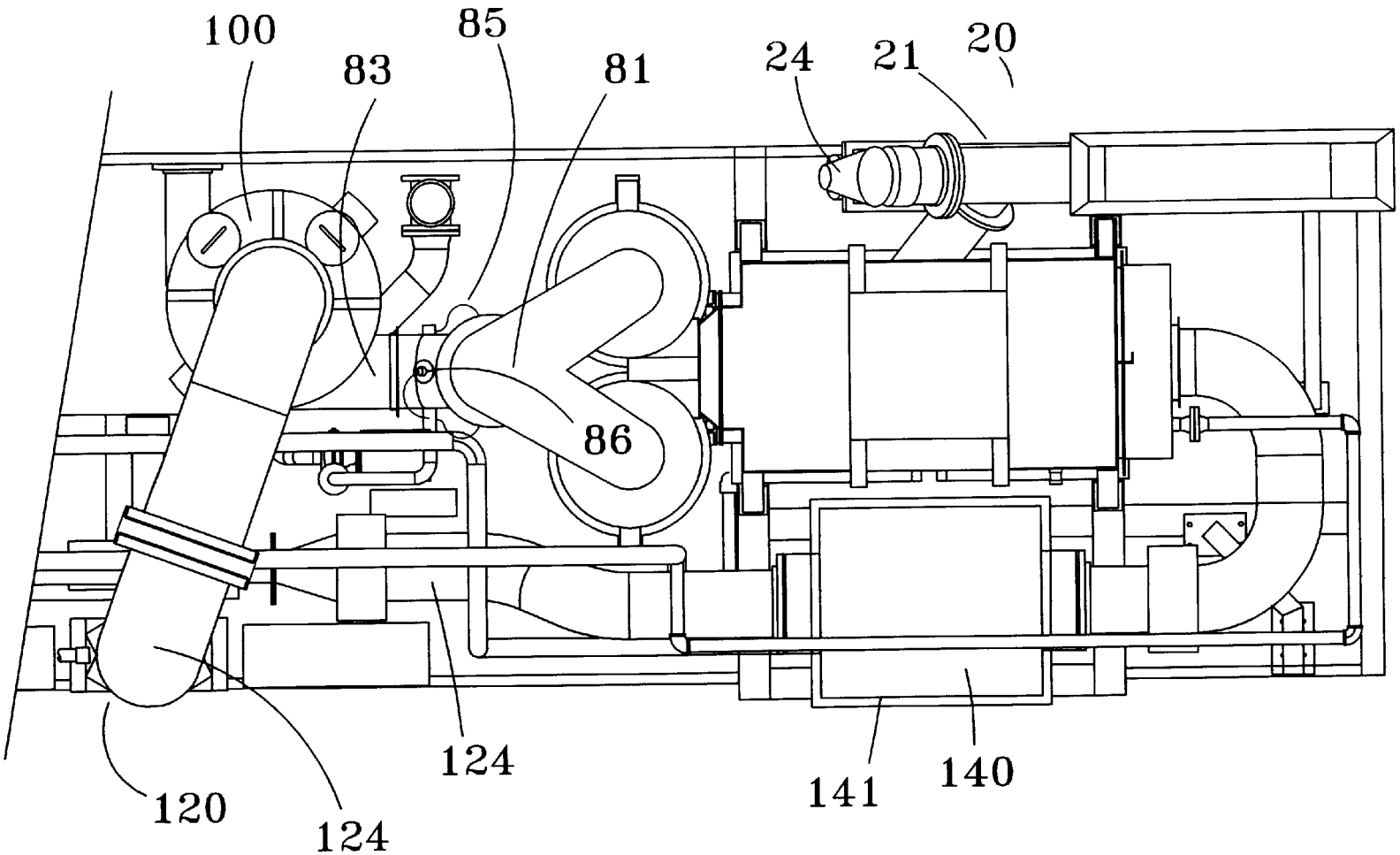
FIG. 5 is an enlarged view similar to the right side of FIG. 1.
Figure 6:
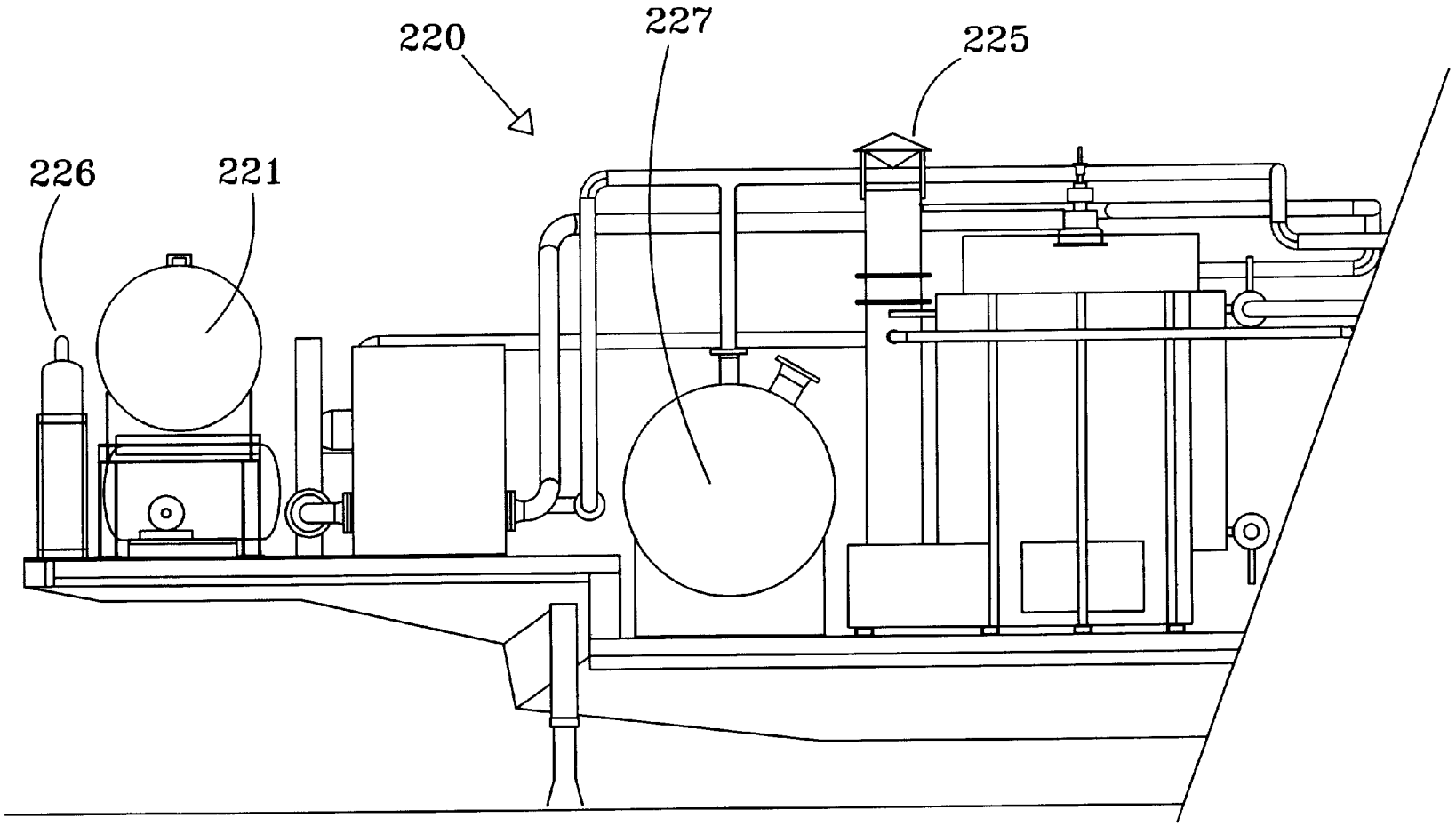
FIG. 6 is an enlarged view similar to the left side of FIG. 2.
Figure 7:
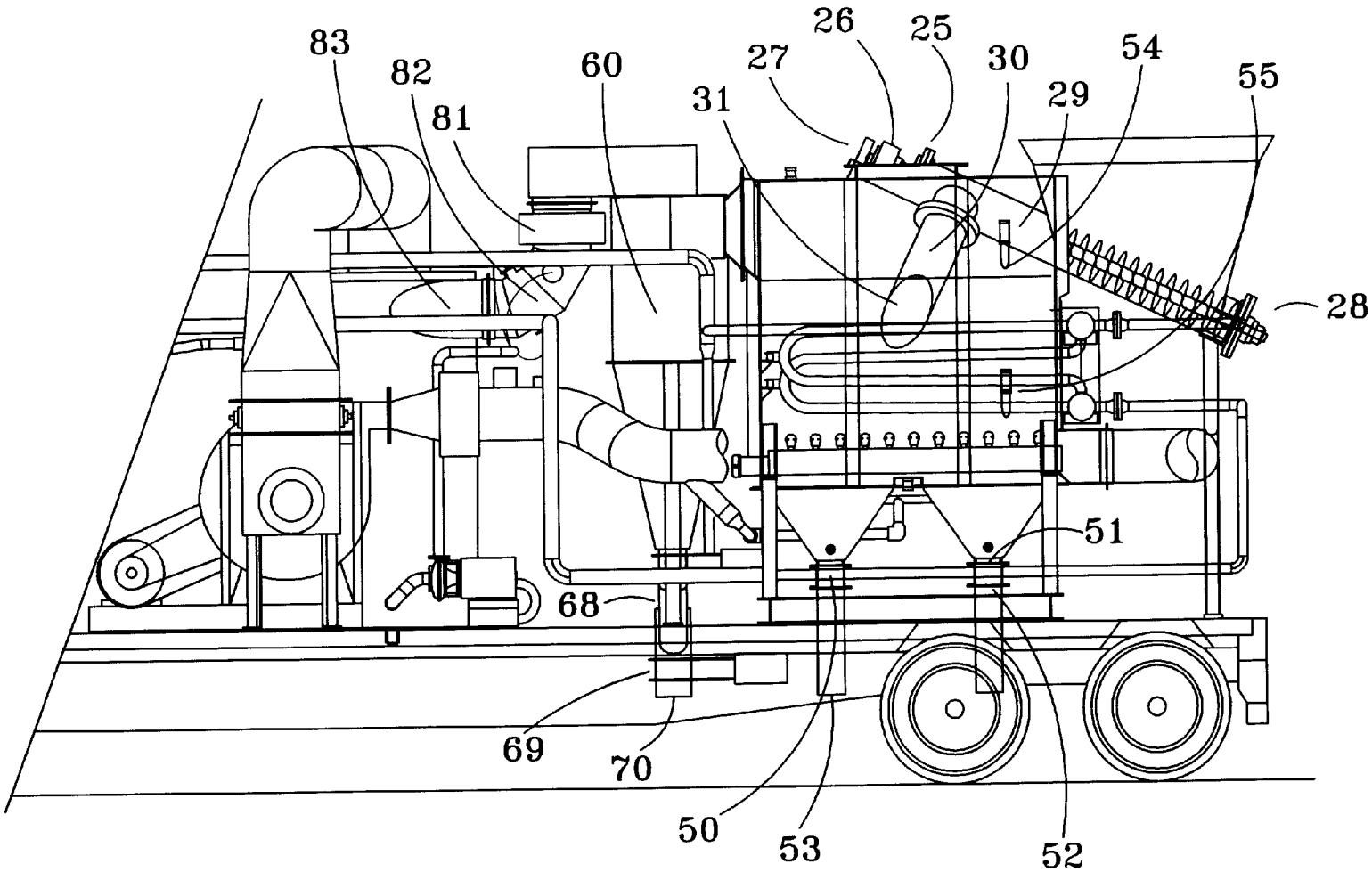
FIG. 7 is an enlarged view similar to the right side of FIG. 2.

An outlet tube 68, connected to an opening defined in an axial location at the top of the hollow cylindrical upper body 62, allows a mixture of gas and hydrocarbons to leave each of the cyclones. The mixture leaving the outlet tube enters the inlet pipe 81 of the spray apparatus 80, as seen in FIGS. 1 and 5, or a condensing apparatus of any known type, as seen in FIGS. 8 and 9.

In a preferred embodiment of the apparatus 10, the mixture of hot gas and hydrocarbons leaving the cyclones enters a spray apparatus 80. The spray apparatus cools the mixture of gases and hydrocarbons and condenses the hydrocarbons from gaseous suspension, converting them to a liquid state. The mechanism by which the hydrocarbons are removed from gaseous suspension involves the discharge of fine droplets by at least one nozzle 86 within the spray apparatus. The heat absorbed by and the contact between the droplets and hydrocarbons suspended within the hot gas results in liquification of the hydrocarbons and cooling of the gas and hydrocarbons mixture.

Referring to FIGS. 1 and 2, an inlet pipe 81 receives the mixture of hot gas and hydrocarbons from the outlet tube 68 of the cyclone 60. A spray tube segment 82 is in communication with the inlet tube, and receives the mixture of hot gas and hydrocarbons. A plurality of nozzles 86 are carried by the spray tube segment, in an orientation which allows the discharge of a fine spray mist of liquid oil directed toward the interior of the spray tube segment.

A pump 84 delivers the liquid oil from the oil-condensing tank 100 or external cooling oil supply to a plurality of hoses 85 under pressure. Each hose supplies oil to an associated nozzle 86. The fine oil droplets discharged by each nozzle come into contact with hydrocarbons suspended in the hot gas. Once in contact, the hydrocarbons are cooled, condensed and absorbed into the fine droplets. The droplets, upon contacting the inside surface of the spray tube segment 82, flow into the outlet pipe 83. The hot gas and liquefied hydrocarbons flow through the outlet pipe into a demisting apparatus 90 carried within the oil-condensing tank 100.

As seen particularly in FIGS. 8 and 9, in one embodiment of the invention, a demister 90 is carried within, or is coextensive with, the oil-condensing tank 100. The demister may be used as a substitute for, or in addition to, the spray apparatus 80. The demister receives the mixture of hot gas and liquefied hydrocarbons from the spray apparatus 80 or cyclone 60. The demister removes the mist, or traces, of hydrocarbons that remain mixed with the gas.

The demister may include any of several configurations. Two possible configurations of a demister are seen in FIG. 8 and a third is seen in FIG. 9. A first configuration, seen in FIG. 8, includes an enclosure 91 having a plurality of chevrons 92. The chevrons are angular metal gas flow obstructions that cause the fast-moving gas molecules to change direction frequently. Such movement is inconsistent with the ability of the gas to hold the hydrocarbons in suspension. As a result, the hydrocarbons tend to form droplets that flow out of the demister and into the lower portion of the oil-condensing tank 100. The gas enters the upper portion of the tank 100.

A first alternative demister, also seen in FIG. 8, includes a cyclone 94. The fast-moving gas passes through the cyclone before entering the upper portion of the tank. The hydrocarbon droplets tend to separate from hot gas and build-up on the inside surfaces of the cyclone. As droplets of hydrocarbons accumulate on the inside surfaces, they flow downwardly where they are released from the bottom of the cyclone and drop into the oil carried in the lower portion of the tank.

A second alternative demister, seen in FIG. 9, includes a steel wool-like substance 93 in place of the chevrons. The steel wool similarly disrupts the flow of the gas, contributing to the inability of the gas to suspend the hydrocarbons. As a result, the hydrocarbons tend to form droplets that flow out of a lower portion of the demister and into the oil-condensing tank.

The oil-condensing tank 100 receives the mixture of gas and liquid oil. Upon entering the oil-condensing tank 100 through an input pipe 104, the oil originally carried by the gas has condensed due to passage through the spray apparatus 80 and/or the demister 90. The liquid oil 103 accumulates in a lower portion of the oil-condensing tank. Hot gas leaves the oil-condensing tank through the output pipe 105.

During operation, the continual addition of oil mixed with the material delivered by the infeed mechanism 20 results in the need to exhaust a quantity of oil from the system. Oil is typically removed through the oil outlet port 102.

Also during operation, the liquid oil tends to become too hot, due to absorption of heat from the in-bed heating tubes 47 in the fluid bed, and due to contact with gas heated by the preheater 140 and released by the nozzles 45 in the fluid bed. This can be a problem because the spray apparatus 80 operates more efficiently when the oil delivered to the pump 84, hoses 85 and associated nozzles 86 is cool. As a result, the oil must either be cooled or replaced with cooler oil. Several methods of doing this are available, as seen below.

As seen in the application of FIG. 9, oil may be removed from the oil-condensing tank for use as drilling fluid, when the apparatus 10 for recovering hydrocarbons from granular solids is used on location at a drilling site. In a similar application, oil may be removed for storage in large on-site tanks. In either of these circumstances, which are illustrated by FIG. 9, an oil outlet port 102 allows oil to be removed. An oil inlet port 101 allows the replacement of the oil removed with cooler oil.

Where no large quantity of cool oil is available for exchange with the hot oil present in the condensing tank 100, a cooling apparatus 110 may be installed to cool the oil in the tank 100.

As seen in FIG. 8, in one embodiment of the cooling apparatus, the oil cooler includes a radiator 111 and fan 112. Using this structure, heat from the oil in the tank is dissipated into the atmosphere.

The fan assembly 120 draws gas out of the oil-condensing tank 100 and delivers it under pressure to the gas preheater 140. The high pressure of the gas developed by the fan assembly at the output 125 is sufficiently greater than at the input 124 to drive the gas in a generally circuitous route from the fan assembly, to the gas preheater 140, to the enclosure 41 of the fluid bed 40, through the cyclones 60, through the spray assembly 80, into the oil-condensing tank 100 and back to the fan assembly.

In a preferred embodiment, seen in FIGS. 1 and 2, a motor 121 powers a belt drive 122 that operates the fan unit 123.

A gas preheater 140 receives gas from the fan assembly and heats the gas prior to its transfer to the plenum of the fluid bed. Where the gas is sufficiently preheated, and where sufficient heat is provided to the in-bed tubes 47 within the fluid bed 40, the mud introduced by the infeed conveyor 20 is fluidized without building up on surfaces within the interior of the fluid bed.

Referring particularly to FIG. 1, the gas preheater includes an enclosure 141 fitted with gas input and output fittings 144, 145. Heat energy is supplied to the gas preheater by thermal fluid, having input and output fittings 142, 143.

In operation, thermal fluid is circulated within the gas preheater. The thermal fluid releases heat energy, which is transferred to the gas moving between the gas input 144 and output 145.

A motor distribution panel 160 and central control panel 180 control use generally known control circuit technology to control the operation of the various devices herein described. These include, by are not limited to, the drive motor for the infeed conveyor, the slide gates associated with fluid bed and the cyclones, the pump 84 of the spray apparatus 80, the fan motor 121 of the fan assembly, the pumps for delivery of the thermal fluid and various control sensors.

As seen in FIGS. 8 and 9, a heat source 210 provides heat to the fluid bed 40 and to the gas preheater 140. The heat source may be any type of thermal fluid, gas, oil or electric source. Flame retention or pulse technology, used with oil or gas, can be used, as can a number of other known burner and furnace technologies.

Figure 4:
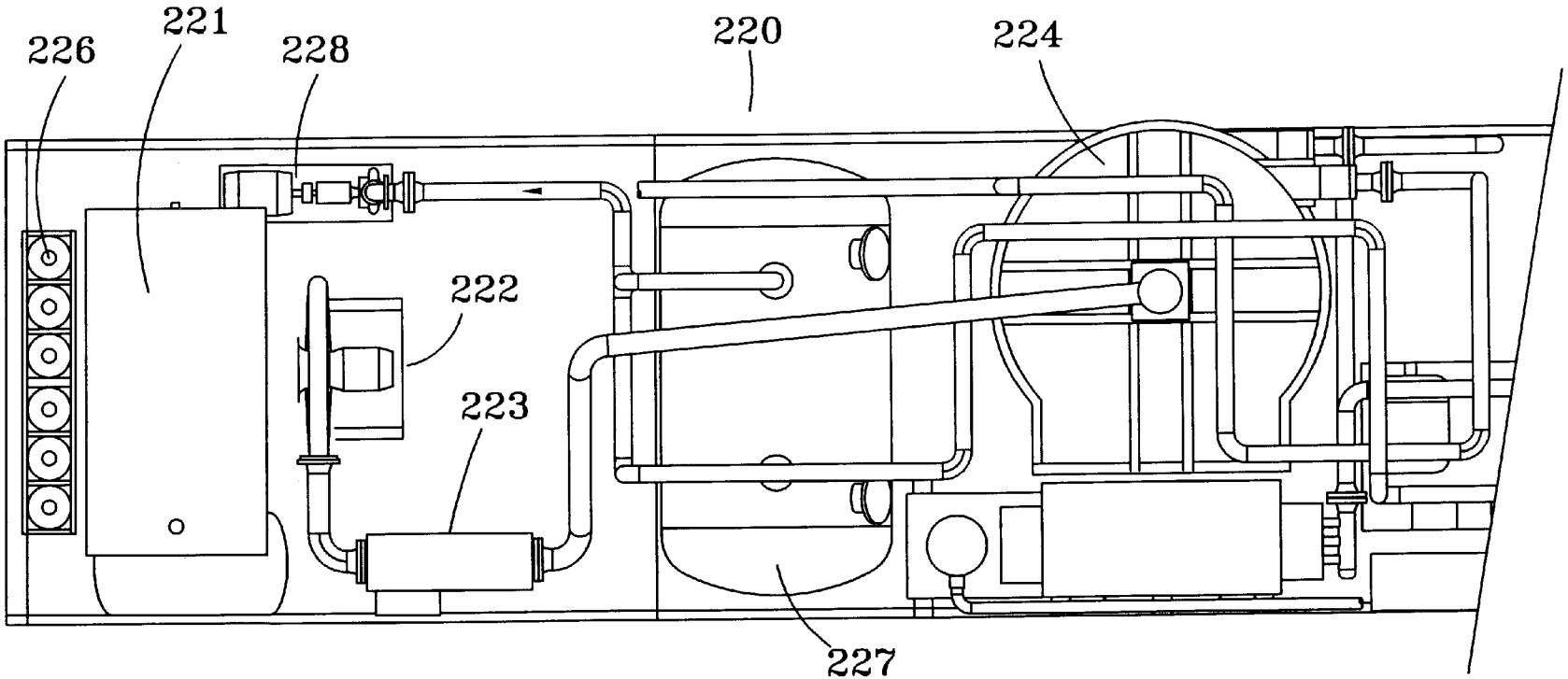
FIG. 4 is an enlarged view similar to the left side of FIG. 1.

A preferred heat source 210 includes the thermal fluid heat source 220 seen particularly in FIGS. 1, 2, 4. Alternatively, a hot gas heat exchanger, direct hot gas exhaust or other heat source could be used.

The thermal fluid heat source 220 provides heated oil or other thermal fluid for use by devices present within the apparatus 10 for recovering hydrocarbons from granular solids. In particular, thermal fluid is circulated into the gas preheater 140 and the in-bed heating heating tubes 47 within the fluid bed 40.

While a preferred thermal fluid heat source burns diesel from a diesel storage tank 221, an alternative thermal fluid heat source could be based on any other energy source. Diesel fuel is moved by a pump and fuel train 223 to a burner 224. Within the burner, the diesel is burned, thereby warming thermal fluid moving through a labyrinth of pipes. Exhaust from the burner is discharged through a stack 225.

The thermal fluid is moved from a thermal fluid storage tank 227, through the thermal fluid heater 224, preheater 140 and in-bed tubes 47 within the fluid bed 40 by a thermal fluid pump 228.

Within the thermal fluid storage tank 227, there is sufficient space for expansion of the thermal fluid due to heating. A nitrogen supply tank 226 provides inert gas for use within the portion of the storage tank not occupied by thermal fluid.

In a preferred embodiment, the apparatus for recovering hydrocarbons from granular solids is portable. A standard truck trailer bed 200 supports the entire apparatus 10, allowing it to be easily moved to any desired location. Similarly, where the apparatus is used in an offshore drilling apparatus, the apparatus may be supported by any desired container, sled or similar portable supporting device for movement to an offshore drilling platform or drilling ship.

The previously described versions of the present invention have many advantages, including a primary advantage of providing a novel apparatus for recovering hydrocarbons from granular solids that uses a fluid bed to fluidize the "mud," at least one cyclone to separate the particulate matter from the hot gas and hydrocarbons, a method of indirectly heating the fluidizing gas and bed and a spray apparatus to remove the hydrocarbons from suspension within the hot gas stream.

Another advantage of the present invention is to provide a novel apparatus for recovering hydrocarbons from granular solids that results in a greater recovery rate than prior art recovery devices using rotating drums and augers, and which leaves the "mud" in a state that is not considered to be hazardous waste. The remediated dirt, soil, cuttings are therefore not considered to be a hazardous waste, and may therefore be disposed of inexpensively.

A still further advantage of the present invention is to provide a novel apparatus for recovering hydrocarbons from granular solids that is well-adapted to high-volume applications, wherein a large quantity of "mud" is processed, resulting in the recycling of hydrocarbons and the elimination of hazardous waste.

Although the present invention has been described in considerable detail and with reference to certain preferred versions, other versions are possible. For example, while a preferred thermal fluid apparatus has been disclosed which provides energy to the process, it is understood that other methods and structures are generally equivalent in function, and could be substituted. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for removing and recovering volatile material from solids, comprising:

(A) a fluid bed, comprising:

(a) an enclosure; and (b) at least one nozzle, carried within the enclosure, for exhausting gas under pressure; and (B) at least one cyclone, in communication with an upper location of the enclosure of the fluid bed, comprising:

(a) a hollow cylindrical upper body defining an upper cavity;

(b) a hollow inverted conical lower body defining a lower cavity in communication with the upper cavity;

(c) a slide gate, carried adjacent to a lower portion of the lower cavity; and (d) an outlet tube, in communication with the upper cavity.

2. The apparatus for removing and recovering volatile material from solids of claim 1, further comprising:

(A) A truck bed, supporting the apparatus for removing and recovering volatile material.

3. The apparatus for removing and recovering volatile material from solids of claim 1, wherein the fluid bed additionally comprises:

(A) in-bed tube means, carried within the enclosure, for supplying heat energy to an interior area defined within the enclosure.

4. The apparatus for removing and recovering volatile material from solids of claim 1, further comprising an infeed conveyor in communication with the fluid bed.

5. The apparatus for removing and recovering volatile material from solids of claim 1, additionally comprising:

(A) condensing apparatus means, in communication with an output of the at least one cyclone, for condensing the volatile material from the hot gas.

6. The apparatus for removing and recovering volatile material from solids of claim 5, wherein the condensing apparatus means comprises a spray apparatus.

7. The apparatus for removing and recovering volatile material from solids of claim 5, further comprising:

(A) an oil-condensing tank, in communication with the condensing apparatus means.

8. The apparatus for removing and recovering volatile material from solids of claim 7, further comprising:

(A) fan assembly means, in communication with the oil-condensing tank, for drawing gas out of an upper portion of the oil-condensing tank and into the at least one nozzle carried within the enclosure of the fluid bed.

9. The apparatus for removing and recovering volatile material from solids of claim 8, further comprising:

(A) gas preheater means, in communication with the fan assembly means, for heating the gas moving from the oil-condensing tank and into the at least one nozzle of the fluid bed.

10. The apparatus for removing and recovering volatile material from solids of claim 9, further comprising:

(A) heat source means for supplying heat energy to the gas preheater means.

11. The apparatus for removing and recovering volatile material from solids of claim 10, wherein the infeed conveyor comprises:

(a) an intake tube having an input end;

(b) a co-axially oriented drive screw;

(c) a plug area, contained within the intake tube, down stream from the drive screw; and (d) a chute, in communication with the intake tube, down stream from the plug area, defining an output end in communication with the fluid bed.

12. An apparatus for removing and recovering volatile material from solids, comprising:

(A) an infeed conveyor, comprising:
(a) an intake tube having an input end;
(b) a co-axially oriented drive screw;
(c) a plug area, contained within the intake tube, down stream from the drive screw; and
(c) a chute, in communication with the intake tube, down stream from the plug area, defining an output end;

(B) a fluid bed, in communication with the chute, comprising:
(a) an enclosure;
(b) a plenum;
(c) at least one manifold, in communication with the plenum;
(d) at least one nozzle, in communication with one of the at least one manifolds;
(e) an inverted cone, carried below the at least one nozzle;
(f) a slide gate, carried at a bottom end of the cone;
(g) in-bed tube means, carried within the enclosure, for supplying heat energy; and
(h) an exhaust tube, in communication with the slide gate;

(C) at least one cyclone, in communication with an upper location of the enclosure of the fluid bed, comprising:
(a) a hollow cylindrical upper body defining an upper cavity;
(b) a hollow inverted conical lower body defining a lower cavity in communication with the upper cavity;
(c) a slide gate, carried adjacent to a lower portion of the lower cavity; and
(d) outlet tube means, in communication with the upper cavity, for exhausting a mixture of hot gas and hydrocarbons;

(D) spray apparatus means, defining a spray tube segment in communication with the outlet tube means, for spraying an oil mist into the mixture;

(E) an oil-condensing tank, in communication with the spray tube segment;

(F) fan assembly means, in communication with the oil-condensing tank, for drawing gas out of an upper portion of the oil-condensing tank and delivering it under pressure to a gas preheater;

(G) whereby the gas preheater heats the gas received from the oil-condensing tank and exhausts the heated gas into the plenum of the fluid bed; and (H) thermal fluid heat source means for supplying heat energy to the gas preheater and the in-bed tube means.

13. The apparatus for removing and recovering volatile material from solids of claim 12, further comprising:

(A) A truck bed, supporting the apparatus for removing and recovering volatile material.

* * * * *